US006742569B2

(12) United States Patent
Edwards

(10) Patent No.: US 6,742,569 B2
(45) Date of Patent: Jun. 1, 2004

(54) HOT MELT APPLICATION OF SOLID PLUNGER LUBRICANT

(75) Inventor: Dean Edwards, The Gables (GB)

(73) Assignee: Chem-Trend, Inc., Howell, MI (US)

( * ) Notice: Subject to any disclaimer, the term of this patent is extended or adjusted under 35 U.S.C. 154(b) by 0 days.

(21) Appl. No.: 10/080,242

(22) Filed: Feb. 21, 2002

(65) Prior Publication Data

US 2003/0155094 A1 Aug. 21, 2003

(51) Int. Cl.[7] ..... B22D 17/00; B29C 47/94

(52) U.S. Cl. ..... 164/149; 164/149; 164/72; 164/267; 164/312; 425/107

(58) Field of Search ..... 164/149, 72, 267, 164/312, 472, 268; 425/107

(56) References Cited

U.S. PATENT DOCUMENTS 3,254,377 A * 6/1966 Morton ..... 164/149
4,664,173 A 5/1987 Wolniak
4,877,568 A * 10/1989 Austin ..... 264/211.21
4,955,424 A * 9/1990 Takehisa et al. ..... 164/72
5,076,339 A * 12/1991 Smith ..... 164/72
5,076,343 A 12/1991 Sandercock
5,388,631 A * 2/1995 Suganuma et al. ..... 164/72
5,472,039 A 12/1995 Schwab
5,662,156 A * 9/1997 Freeman ..... 164/61
5,988,461 A * 11/1999 Edney et al. ..... 222/638
6,039,108 A * 3/2000 Hanano et al. ..... 164/72
6,244,388 B1 6/2001 Yun
6,432,886 B1 * 8/2002 Reidmeyer ..... 508/114

* cited by examiner

*Primary Examiner*—Kiley Stoner
*Assistant Examiner*—Kevin McHenry
(74) *Attorney, Agent, or Firm*—Rader, Fishman & Grauer, PLLC

(57) ABSTRACT

The present invention relates to a die casting machine which includes a dispenser that causes a plunger lubricant to undergo a phase change. The dispenser also dispenses the plunger lubricant. The present invention also relates to a method of lubricating a die casting machine which involves effecting a phase change in the plunger lubricant prior to dispensing the plunger lubricant. The present invention also relates to a plunger lubricant blank which under goes a phase change in the dispenser.

21 Claims, 1 Drawing Sheet

HOT MELT APPLICATION OF SOLID PLUNGER LUBRICANT

FIELD OF THE INVENTION

This invention relates to plunger lubricants and their use in die casting processes.

BACKGROUND OF THE INVENTION

Although die casting processes have been known for many years, problems still exist. One of the continuing problems relates to area of plunger lubricants and other lubricants necessary for the efficient and cost effective manufacture of die cast metal parts. Known lubricants have a variety of environmental, safety and housekeeping issues.

A die casting apparatus generally comprises a die and a shot sleeve. The molten metal to be cast is introduced into the shot sleeve. A plunger axially extends into the shot sleeve to push the molten metal into the die. The shot sleeve and plunger require lubrication because the molten metal can solder itself to the shot sleeve and/or the plunger and because of the plunger can generate significant amounts of additional heat from friction as it rubs against the shot sleeve. Furthermore, lubricants help prevent the plunger from rubbing unevenly against the inside wall of the shot sleeve. The uneven rubbing prevents a smooth plunger movement which may result in a sub par cast, which must be discarded. The uneven rubbing also leads to significantly increased wear and tear on the plunger and the shot sleeve, which cause increase down time, repair costs and eventually will necessitate the replacement of the plunger.

Various kinds of lubricants have been utilized in the past with less than satisfactory results. Oil-based lubricants are disfavored because they tend to smoke and degrade when they come in contact with the molten metal or the shot sleeve that is hot from repeated use. Oil-based lubricants required large amounts of warehouse space because they are bulky. Furthermore, oil-based lubricants present a slip-and-fall hazard if spattered on the floor.

Water-based lubricants avoid the smoking and degrading of oil based lubricants, but suffer their own drawbacks. The major draw back is that the water carrier must be completely evaporated prior to the introduction of the molten metal because a violent reaction could result if the molten metal comes into contact with water. Water-based lubricants are typically sprayed into the shot sleeve through the use of compressed air. The noise of the compressed air and the machinery used to produce the compressed air requires that soundproofing structures be utilized with the consonant added expense. In addition, liquid lubricants require pumps and tubes which are susceptible to mechanical failure from extended periods of use. Water-based lubricants often include particulate materials such as graphite or other inorganic particles which tend to coagulate at or in the spray nozzle used to apply the lubricant. This decreases the reliability of the machinery used to apply the lubricant because the nozzle must be periodically cleaned. Furthermore, partial lubrication of the shot sleeve can result from a partially blocked nozzle, thus leading to uneven rubbing of the plunger in the shot sleeve and its attendant problems. Water-based lubricants also required large amounts of warehouse space because they are bulky.

Other kinds of lubricants including solids in the form of pellets, powders and flakes have been used. These suffer some of the same defects as water-based lubricants. Known pelleted lubricants tend to bounce on the floor during application and create a slip-and-fall hazard. Powder and flake lubricants may require complicated additional machinery to effect their use, thus making their utilization more expensive and labor intensive. Furthermore, the lubricant materials may be more expensive than water-based materials because of their limited availability.

In addition, all known lubricants suffer from serious cleanliness problems. Known liquid lubricants tend to spatter excessively when applied. Known powdered lubricant tend to create dusty working conditions. In either case, significant amounts of time, energy and money must be expended to keep the work area clean and safe because spattered lubricants interfere with the switch out of empty lubricant containers, create unpleasant working conditions, and may be a fire hazard.

Accordingly, the inventor has recognized a need for improve plunger lubricants, and associated processes of applying those lubricants, which overcome one or more of these drawbacks.

SUMMARY OF THE INVENTION

The present invention relates to a die casting machine which includes a dispenser that causes a plunger lubricant to undergo a phase change. The dispenser also dispenses the plunger lubricant. The present invention also relates to a method of lubricating a die casting machine which involves effecting a phase change in the plunger lubricant prior to dispensing the plunger lubricant. The present invention also relates to a plunger lubricant blank which under goes a phase change in the dispenser.

DETAILED DESCRIPTION

Figure 1:
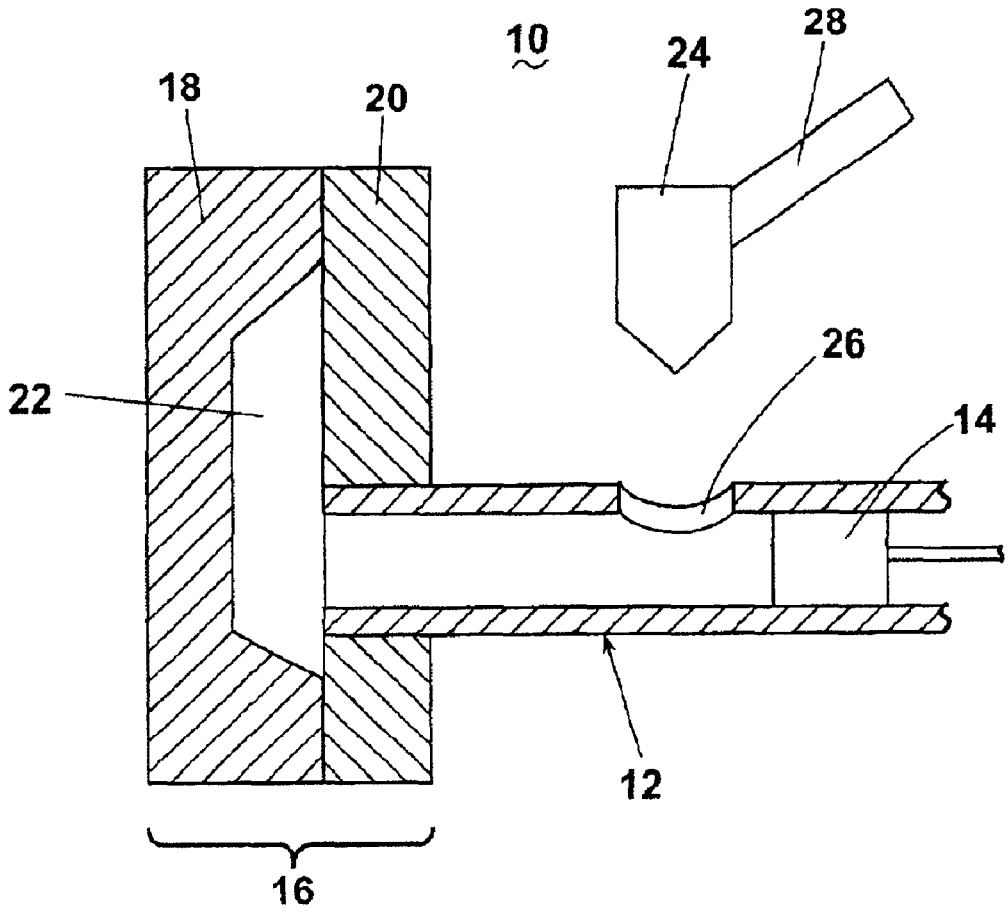
FIG. 1 shows a die casting machine in which the present invention may be utilized.

Referring to the FIG. 1, a die casting machine 10 includes a horizontal cylindrical shot sleeve 12. A plunger 14 is movable within the shot sleeve 12 from a retracted position, which is shown in FIG. 1 to an advanced position (not shown) close to a die 16. The die 16 comprises die halves 18 and 20 which define a die cavity 22. The shot sleeve 12 is in fluid communication with the die cavity 22.

In operation, a lubricant according to the present invention is loaded into a dispenser 24. From dispenser 24, the lubricant is introduced into the shot sleeve 12 through pour hole 26. This is done at the beginning of each operating cycle, while the plunger 14 is in its retracted position as shown in FIG. 1. The desired amount of molten metal is then introduced into the shot sleeve 12 through the pour hole 26. The plunger 14 is then advanced forward in the direction of the die 16 until it blocks the pour hole 26. It is then further advanced a predetermined distance, injecting the molten metal into the die cavity 22. After a pre-set dwell time, which permits the molten metal to solidify, the die 16 is opened and the plunger 14 is then further advanced to complete a full stroke in which the casting is released from the stationary half 20 of the die. This also forces the residual, solidified plug from the shot sleeve 12. The plunger 14 is then retracted to a starting position and the casting is ejected from the movable half 18 of the die. The machine is then ready for another cycle.

The dispenser may include a hopper where the plunger lubricant is received and stored in bulk prior to being dispensed. One possible embodiment of a hopper is shown in FIG. 1 at reference numeral 28. Any suitable dispenser may be utilized, with the emphasis placed on selecting one that can provide a measured amount of plunger lubricant in an inexpensive manner. In one useful embodiment, the dispenser is a hot-melt dispenser. The dispenser may be connected to the shot sleeve at the pour hole. Alternatively, the dispenser may be separate from the shot sleeve, as shown in FIG. 1.

The dispenser may also include a nozzle to aid in dispensing the plunger lubricant. Any type of nozzle may used in conjunction with the dispenser. However, preferred nozzles are those which create a minimum amount of splatter, dispense a measured amount of lubricant, and also achieve the desired pattern of lubricant coverage within the shot sleeve. For example, the nozzle may provide the lubricant in a drop-wise manner, in a stream, in a spray, or in a mist, such as an air atomized spray. A variety of additional components and methodologies may be used to facilitate the dispensing of plunger lubricant.

The plunger lubricant may be any suitable lubricant for the application in which the lubricant is to be used. Typical materials which are capable of lubricating the shot sleeve are contemplated for use in the composition of the invention. The preferred plunger lubricant is selected to be relatively low smoking, to be relatively inexpensive to manufacture, and relatively easy to load into of the dispenser. One preferred plunger lubricant is a solid lubricant which has a melting temperature in the range of operating temperatures of the shot sleeve in which the lubricant is to be used.

Lubricants may include, by way of example only, metal soaps, fatty acids, graphite, ceramics, high melting polymer resins, natural and synthetic waxes, gilsonite, glasses, and mixtures of these materials.

Useful metal soaps include many sulfonates, naphthenates, and carboxylates. Of these, fatty acid soaps such as zinc stearate and sodium stearate are preferred on account of their known properties, their ready availability and low cost. However, other metal soaps known for their lubricant properties, including, by way of example only, tin, copper, titanium, lithium, calcium, magnesium and other alkali and alkaline earth metal soaps of fatty acids, may be advantageously included.

Fatty acids may also be included, and their relatively low cost, ready availability, and their contribution to the overall lubricity of the composition makes them attractive for such use. One example is stearic acid, which is advantageously used since it has good lubricating properties, is nontoxic, inexpensive, and readily available.

Materials such as graphite and ceramic materials such as boron nitride, silicon nitride, or chromium carbide are useful for additives to plunger lubricants, as are molybdenum sulfides.

Useful high melting polymer resins include, by way of example, polyethylene, polypropylenes, polyvinylchlorides, polyvinyl alcohols, polyvinyl acetates celluloses, polyesters, polyethylene glycols, polyacrylates, polymethacrylates, polystyrenes, epoxy resins, silicone resins, polyamides, and any copolymer resins of the above. Indeed, almost any thermoplastic material may be used.

Of the natural and synthetic waxes which may be advantageously employed, polyethylene waxes of relatively high molecular weights are in general preferred on account of the lubricity which they impart. However, polypropylene, bisamide, ester, microcrystalline, beeswax, paraffin, oxidized, copolymer and camrnuba waxes are also preferred.

Glass materials useful in the present invention are preferably alumina, alumina/silica, silica, or borax. Optionally, these glass materials may be used in chopped fiber form. Diatomaceous earth, talc, mica, other metal oxides, boric acid, wood flour and phosphorus compounds, including phosphate esters may also be useful.

The plunger lubricant may be in any form, shape and size that is conveniently used in the dispenser and/or loaded into the hopper. For example, preferred lubricants may be a powder, a particulate, a flake or a solid blank, in the shape of a tube, a rod, a disc, or a brick. Furthermore, the lubricant may be a solid blank coiled on a spool. Depending on the form, shape and size of lubricant selected, a variety of manual and automatic apparatuses may be used to load the lubricant into the hopper. Preferably, the plunger lubricant is a solid blank.

In operation, the dispenser effects a phase change of the plunger lubricant by providing the necessary operating conditions to promote a phase change from one phase state to another phase state in the lubricant. The plunger lubricant under goes, at least partially, at least one phase change after being loaded into the dispenser. The phase change takes place prior or simultaneously to the plunger lubricant being dispensed. For convenience, both situations will be referred to as the phase change taking place prior to being dispensed. Although lubricants which change phase from solid to liquid are preferred, lubricants which change phase from liquid to solid are also contemplated.

While a single phase change for the lubricant is preferred, the lubricants may also under go multiple phase changes such that the lubricant cycles between phases while in the dispenser. In addition, lubricants may undergo partial phase changes such that two phase states exist concurrently in the dispenser. Preferably, prior to dispensing, the plunger lubricant which is ready to be dispensed, i.e., lubricant that is near the nozzle, has substantially completed the phase change from one phase state to the other phase state, although a complete phase change is not required. Stated alternatively, while it is preferred the plunger lubricant is in a single phase state when it is dispensed, plunger lubricant which has two phase states may also be dispensed. Such lubricants may be a combination of materials which melt and which do not melt under the normal operating conditions for die casting machines.

After the proper phase state, or combination of phase states, for the lubricant has been achieved in the dispenser, the dispenser dispenses the lubricant, preferably through a nozzle, into the shot sleeve. The lubricant, when received in the shot sleeve, may be in the same or different phase state as when it was dispensed. In addition, the lubricant may also be in a combination of phase states when it is received in the shot sleeve. In one embodiment, the lubricant is dispensed as a liquid and is a liquid when it is received in the shot sleeve. In another embodiment, the lubricant is dispensed as liquid and is a solid when received in the shot sleeve. In a third embodiment, the lubricant is dispensed as a liquid and has a solid shell with a liquid center when received in the shot sleeve. In a forth embodiment, the lubricant is dispensed as a combination of solid and liquid and is a liquid when received in the shot sleeve. In a fifth embodiment, the lubricant is dispensed as a combination of solid and liquid and is a combination of solid and liquid when received in the shot sleeve. This embodiment covers lubricants which may be a combination of materials with melt and which do not melt under normal operating conditions for die casting machines.

While the invention has been specifically described in connection with certain specific embodiments thereof, it is to be understood that this is by way of illustration and not of limitation, and the scope of the appended claims should be construed as broadly as the prior art will permit.

What is claimed is:

1. A die casting machine, comprising:

a shot sleeve adapted to receive a plunger lubricant; and a dispenser adapted to cause the plunger lubricant in a first phase state to undergo, at least partially, a phase change to a second phase state and adapted to dispense the plunger lubricant into the shot sleeve.

2. The die casting machine of claim 1, further including a plunger lubricant, wherein the dispenser is adapted so that the first phase state of the plunger lubricant is solid and the second phase state is liquid.

3. The die casting machine of claim 1, wherein the dispenser is adapted to dispense the plunger lubricant substantially in the second phase state.

4. The die casting machine of claim 1, wherein the dispenser includes a nozzle adapted to provide a measured quantity of the plunger lubricant.

5. The die casting machine of claim 4, wherein the nozzle is selected from the group consisting of a drop-wise nozzle, a stream nozzle, or a spray nozzle.

6. The die casting machine of claim 1, wherein in the dispenser further includes a hopper.

7. The die casting machine of claim 1, further including a plunger lubricant, wherein the dispenser is adapted to effect a second phase change in the plunger lubricant.

8. The die casting machine of claim 1, wherein the dispenser includes a storage device adapted to store the plunger lubricant in the first phase state.

9. The die casting machine of claim 8, further including a plunger lubricant, wherein the storage device is adapted to store the plunger lubricant as a solid blank.

10. A die casting machine, comprising:

a dispenser adapted to cause a plunger lubricant in a first phase state to undergo, at least partially, a phase change to a second phase state and adapted to dispense the plunger lubricant; and a shot sleeve adapted to receive the plunger lubricant from the dispenser.

11. The die casting machine of claim 10, wherein the dispenser includes a storage device adapted to store the plunger lubricant in the first phase state.

12. A method of lubricating a die casting machine, comprising:

storing a plunger lubricant in a first phase state;

effecting a phase change in a plunger lubricant using a dispenser; and dispensing the plunger lubricant into the die casting machine.

13. The method of claim 12, wherein the plunger lubricant is dispensed into a shot sleeve.

14. The method of claim 12, wherein the effecting step occurs prior to the dispensing step.

15. The method of claim 12, wherein the effecting step occurs simultaneously to the dispensing step.

16. The method of claim 12, wherein the phase change is from solid to liquid.

17. The method of claim 12, further comprising effecting a second phase change in the plunger lubricant.

18. The method of claim 12, wherein the dispensing step further includes dispensing the plunger lubricant in a manner selected from the group consisting of drop-wise, a stream, or a spray.

19. The method of claim 12, wherein the effecting step further includes melting the plunger lubricant.

20. A die casting machine, comprising:

a dispenser adapted to cause a plunger lubricant in a first phase state to undergo, at least partially, a phase change to a second phase state and adapted to dispense the plunger lubricant into a shot sleeve, wherein the dispenser is adapted to dispense the plunger lubricant in two phase states.

21. A die casting machine, comprising:

a dispenser adapted to cause a plunger lubricant in a first phase state to undergo, at least partially, a phase change to a second phase state and adapted to dispense the plunger lubricant into a shot sleeve, wherein the dispenser and the shot sleeve are adapted to prevent a second phase change in the plunger lubricant.

* * * * *